US011198961B2

(12) United States Patent
Chathuranga Perera et al.

(10) Patent No.: US 11,198,961 B2
(45) Date of Patent: Dec. 14, 2021

(54) CONDUCTIVE PATHWAY

(71) Applicant: MAS INNOVATION (PRIVATE) LIMITED, Colombo (LK)

(72) Inventors: H. A. Malaka Chathuranga Perera, Colombo (LK); Kosala Jayasundara, Colombo (LK); M. Chammika Perera, Colombo (LK); Kalu Arachchige Manjula Nayanajith Jayawardana, Colombo (LK)

(73) Assignee: MAS INNOVATION (PRIVATE) LIMITED, Colombo (LK)

( * ) Notice: Subject to any disclaimer, the term of this patent is extended or adjusted under 35 U.S.C. 154(b) by 209 days.

(21) Appl. No.: 16/472,317

(22) PCT Filed: Jan. 3, 2018

(86) PCT No.: PCT/SG2018/050002
§ 371 (c)(1),
(2) Date: Jun. 21, 2019

(87) PCT Pub. No.: WO2018/128584
PCT Pub. Date: Jul. 12, 2018

(65) Prior Publication Data

US 2019/0376214 A1 Dec. 12, 2019

(30) Foreign Application Priority Data

Jan. 4, 2017 (SG) ..... 10201700042S

(51) Int. Cl.
*D04B 21/14* (2006.01)
*D02G 3/12* (2006.01)
(Continued)

(52) U.S. Cl.
CPC ..... *D04B 21/14* (2013.01); *D02G 3/12* (2013.01); *D02G 3/32* (2013.01); *D02G 3/441* (2013.01);
(Continued)

(58) Field of Classification Search
CPC ..... D04B 21/14; D04B 21/16; D04B 21/18; D04B 21/207; D04B 23/12; D04B 23/16
See application file for complete search history.

(56) References Cited

U.S. PATENT DOCUMENTS 2,569,764 A * 10/1951 Jonas ..... A43B 23/17 36/68
4,753,088 A * 6/1988 Harrison ..... D04B 21/12 2/125
(Continued)

FOREIGN PATENT DOCUMENTS

WO 2015/108427 A1 7/2015

OTHER PUBLICATIONS

International Search Report issued in PCT/SG2018/050002 dated May 18, 2018 (7 pages).
(Continued)

*Primary Examiner* — Danny Worrell
(74) *Attorney, Agent, or Firm* — Osha Bergman Watanabe & Burton LLP

(57) ABSTRACT

Disclosed herein are composite materials suitable for use in wearable technology and other similar applications. The composite includes a fabric (12, 20, 30, 40) and a wire (11, 22, 32, 41, 1100, 1210) hidden within the fabric (12, 20, 30, 40) in such a way that the fabric (12, 20, 30, 40) protects the wire (11, 22, 32, 41, 1100, 1210) from mechanical stresses. In addition, the wire (11, 22, 32, 41, 1100, 1210) may comprise a yarn material that has a core of an elastic
(Continued)

polymeric material surrounded by a wire. Processes to make these materials are also disclosed herein.

17 Claims, 8 Drawing Sheets

(51) Int. Cl.
*D02G 3/32* (2006.01)
*D02G 3/44* (2006.01)

(52) U.S. Cl.
CPC .... *D10B 2101/20* (2013.01); *D10B 2401/061* (2013.01); *D10B 2401/16* (2013.01)

(56) References Cited

U.S. PATENT DOCUMENTS 5,416,961 A * 5/1995 Vinay ..... D04B 23/12 28/165
6,341,504 B1 * 1/2002 Istook ..... D04B 21/18 66/172 E
7,028,510 B1 * 4/2006 Rosa ..... D04B 21/20 66/190
8,034,001 B2 * 10/2011 Gal ..... D04B 21/06 600/536
8,966,942 B2 * 3/2015 Dias ..... D04B 1/24 66/170
9,032,762 B2 * 5/2015 Begriche ..... D04B 1/22 66/171
9,211,085 B2 * 12/2015 Streeter ..... A61B 5/6823
9,387,727 B2 * 7/2016 Pax ..... B60C 9/18
9,932,697 B2 * 4/2018 Chung ..... D05B 17/00
9,963,808 B2 * 5/2018 Yamaguchi ..... D04B 21/14
10,184,194 B2 * 1/2019 Henry ..... D04B 1/14
10,385,487 B2 * 8/2019 Jeon ..... D04B 21/14
10,717,351 B2 * 7/2020 Paris ..... D04B 21/14
10,753,021 B2 * 8/2020 Nurkka ..... D04B 21/18
2004/0237494 A1 12/2004 Karayianni et al.
2005/0061802 A1 3/2005 Rock
2013/0102217 A1 4/2013 Jeon

OTHER PUBLICATIONS

Written Opinion issued in PCT/SG2018/050002 dated May 18, 2018 (14 pages).

* cited by examiner

CONDUCTIVE PATHWAY

FIELD OF INVENTION

The current invention relates to a conductive path suitable for use in wearable electronics.

BACKGROUND

The listing or discussion of an apparently prior-published document in this specification should not necessarily be taken as an acknowledgement that the document is part of the state of the art or is common general knowledge.

In the field of e-textiles, one application of which is wearable electronics, electrical and electronic circuitry can be created in or on textiles and apparel by several different methods.

For example, conductive paths may be printed on textile substrates, using screen printing or template printing. Here the screen or the template will be made with open areas for the required conductive regions. The screen or template is placed precisely on the substrate at the desired position for the conductive circuit traces. The print paste or ink used in these methods generally consists of a conductive powder of suitable particle size such as silver, copper, or carbon, and a binder such as acrylic, epoxy, or silicone. The paste or ink is applied on to the textile substrate by the appropriate printing method and is cured under suitable curing conditions to produce a conductive textile product.

The conductivity of the conductive path depends on the width and thickness of the path and the composition of the print paste. Since printing methods may employ screens or templates, not only can products in which conductive paths appear on only one side of the textile substrate be made, but it is also possible to apply relatively complex patterns of conductive paths on the substrate. However, in most instances the applied conductive paths cannot stretch with the substrate without cracking, and printing methods are thus generally unsuitable for products where stretchability is important.

Some proposed printing methods use silicone based conductive inks to provide some level of stretchability. A problem with these inks is that the conductivity decreases when the printed conduction paths are stretched. This makes them unsuitable for applications such as analog signal transfer, where constant conductivity during stretch is essential.

Other template-based conductive material deposition techniques are also known. In general these techniques have the same disadvantages as printing-based methods, in that the conductive material may break (thereby interrupting the conduction path) or the conductivity may change when the substrate is stretched.

In relation to electronic garments, particularly those incorporating sensors and the like, it is highly desirable to have stretchable circuits given that the sensors etc. that are to be used should generally touch the wearer's body at all times. Stretchable circuits typically require stretchable fabric substrates. Presently known methods of achieving stretchable conductive paths on garments have many flaws, in particular being susceptible to reduced conductivity (which is difficult to predict as it is a nonlinear effect).

Alternative methods produce conductive textiles using conductive yarns or thread in the fabric manufacturing process. The conductive threads or yarns may be made of 100% conductive materials, or a combination of standard textile yarn material and conductive material. Additionally the yarn or thread may have a dielectric layer as the outer-most layer to provide electrical insulation. When conductive threads are used in fabric manufacturing, for example in a weaving or knitting process, they are interlaced or inter-looped in the machine direction or the cross direction. Weaving or knitting therefore, in general, cannot create non-linear and complex patterns for the conduction path, and cannot accommodate significant levels of stretching of the substrate, so may be of limited use for advanced wearable electronic apparel applications. Although woven and knitted fabrics can be cut to the shape of the desired conductive paths for use as an appliqué on a substrate, their use is generally limited to applications where only a few conductive paths are required and a low level of stretch is permitted. In addition, cutting and re-application of the cut conductive paths onto the substrate is a manual and cumbersome process, and leads to the wastage of costly conductive materials.

In order to address the above problem associated with woven or knitted conductive threads, sewing or embroidery machinery can be used instead. This has previously been done in order to create conductive paths on textile substrates which can accommodate some degree of stretch. Several examples of conductive embroidery threads and embroidered circuits are known; see, for example, U.S. patent application Ser. Nos. 09/160,540 and 11/409,243, U.S. Pat. Nos. 7,025,596 and 8,505,474, and European Patent Publication EP 1633429 A1. Embroidered or sewn circuits can address some of the disadvantages of the methods described above.

In most embroidered circuits, the conductive thread is used as the needle thread and a non-conductive (e.g., cotton) thread is used as the bobbin thread. As such, a disadvantage of embroidered circuitry is that the embroidery undesirably changes the appearance and tactility of both surfaces of the garment. To overcome this, it is necessary to use masking in the form of an additional substrate applied to the non-conductive thread, producing a multilayer composite which is heavy and bulky and thus unsuitable for applications such as sportswear, or apparel requiring high flexibility and stretchability and adaptation to body contours during use. Further, additional process steps are required, increasing the cost of manufacture.

In addition, the above methods may place limitations on the kinds of further processing that can be conducted to finish the product. For example, the use of certain conductive threads may limit the maximum temperatures that can be used when preparing the final product, as otherwise the threads may suffer irreparable damage.

Embodiments of the present invention seek to solve or alleviate one or more of the above problems, or at least to provide a useful alternative.

SUMMARY OF INVENTION

Thus, in a first aspect of the current invention, there is provided a composite material comprising:

a conductive wire; and a yarn, wherein the yarn forms a warp-knitted fabric containing loops and the conductive wire is laid in a pattern that passes through the loops of the warp-knitted fabric, such that a locking stretch of the yarn within the warp-knit fabric is less than the pattern stretch of the conductive wire.

In a first embodiment of the first aspect, the conductive wire may be a high-temperature insulated metal wire that comprises a metal wire and a high-temperature insulation coating material.

Alternatively, in a second embodiment of the first aspect, the conductive may wire comprise a high-temperature insulated metal wire and an elastic yarn, wherein the conductive wire is spirally-wrapped around the elastic yarn.

In more specific embodiments of the first and second embodiments of the first aspect of the invention:

(a) the high-temperature insulation coating material may be selected from one or more of the group selected from PTFE, PET, fiberglass, silicone rubber, nylon, ethylene propylene rubber (EPR), natural rubber, optionally wherein the high-temperature insulation coating material has a thickness of from 30 μm to 200 μm, such as from 40 μm to 120 μm, such as 80 μm;

(b) the metal wire may be formed from a plurality wirelets, each having a diameter of from 5 μm to 200 μm (e.g. from 15 μm to 150 μm, such as from 25 μm to 50 μm);

(c) there may be from 4 to 50 wirelets (e.g. from 10 to 45 wirelets, such as from 15 to 30 wirelets);

(d) the metal wire may be formed from the plurality of wirelets has a diameter of from 0.10 mm to 1.50 mm (e.g. from 0.12 to 1.00 mm, such as from 0.14 mm to 0.3 mm);

(e) the metal of the metal wire may be selected from one or more of the group selected from nickel or more particularly, copper, silver, gold, stainless steel, and alloys thereof, optionally wherein, when the metal wire may be formed from a plurality of wirelets, each wirelet is coated with one or more of the group selected from nickel or, more particularly, tin, gold, silver, stainless steel and alloys thereof;

(f) the high-temperature insulated metal wire may further comprise a polymeric core material surrounded by the metal wire, optionally, wherein:

(i) the total diameter of the high-temperature insulated metal wire comprising the polymeric core material may be from 0.15 mm to 3.50 mm, such as from 0.25 mm to 1.00 mm, such as from 0.30 mm to 0.50 mm (e.g. 0.39 mm);

(ii) the polymeric core may be nylon;

(iii) the polymeric core may be formed as a plurality of yarnlets, optionally wherein there are from 20 to 500 yarnlets (e.g. from 50 to 300 yarnlets, such as 150 yarnlets;

(g) the high-temperature insulated metal wire has a resistance of from 0.1 to 20 Ohms/metre (e.g. from 0.2 to 1 Ohms/metre)

(h) the total diameter of the high-temperature insulated metal wire may be from 0.10 mm to 3.00 mm, such as from 0.15 mm to 1.00 mm, such as from 0.20 mm to 0.40 mm (e.g. 0.22 mm or 0.39 mm).

In a third embodiment of the first aspect, the conductive wire may be an uninsulated wire that is selected from one or more of the group selected from nickel or, more particularly, copper, silver, gold, and stainless steel, silver coated nylon, and a conductive carbon-containing yarn, optionally wherein the uninsulated wire is uncoated or is coated with one or more of nickel or, more particularly, tin, gold, silver or stainless steel.

In more specific embodiments of the third embodiment of the first aspect of the invention:

(a) the total diameter of the uninsulated wire may be from 0.05 mm to 3.00 mm, such as from 0.15 mm to 1.00 mm, such as from 0.20 mm to 0.25 mm (e.g. 0.22 mm);

(b) one or more insulation layers may be applied over the composite material to cover the uninsulated wires.

In yet more specific embodiments of the first aspect of the invention and all embodiments hereinbefore:

(i) the conductive wire may be laid in a zig-zag or sinusoidal pattern through the warp-knitted yarn;

(ii) the conductive wire may be a plurality of wires, optionally wherein the number of wires is from 1 to 180, such as from 2 to 50, such as 4 to 10 and/or the plurality of wires may be laid to form connection nodes within the fabric;

(iii) the composite material comprises the whole or part of a garment, an accessory, an electrical conduit, a house decoration and vehicle upholstery;

(iv) the composite material may further comprise one or more bonding yarns incorporated into the fabric and lying on a top and/or bottom surface of the fabric.

In a second aspect of the invention, there is provided a composite material comprising:

at least one insulated conductive wire; and a warp-knitted fabric containing loops formed from a non-heat soluble yarn and a heat-soluble yarn, wherein one or more wire-containing regions are formed in the warp-knitted fabric, where each wire-containing region is defined by a first non-heat soluble yarn thread at a first position and by a second non-heat soluble yarn thread at a second position, and the at least one conductive wire is laid in a pattern that passes through the loops of the warp-knitted fabric in one of the at least one or more wire-containing regions such that a locking stretch of the yarn within the warp-knit fabric is less than the pattern stretch of the conductive wire.

In embodiments of the second aspect of the invention:

(a) the one or more wire-containing regions of the warp-knitted fabric containing loops may further comprise a fusible adhesive yarn to form at least part of the fabric in the wire-containing region between the first and second non-heat soluble yarn threads;

(b) the insulated conductive wire is selected from one or more of the group selected from nickel or, more particularly, copper, silver, gold, and stainless steel, silver coated nylon, and a conductive carbon-containing yarn, optionally wherein the uninsulated wire is coated with one or more of nickel or, more particularly, tin, gold, silver or stainless steel;

(c) the insulated conductive wire may be insulated by a fusible coating material, optionally wherein the fusible coating material is TPU;

(d) the insulated conductive wire may have a total diameter of from 0.10 mm to 3.00 mm, such as from 0.15 mm to 1.00 mm, such as from 0.20 mm to 0.25 mm (e.g. 0.22 mm);

(e) the insulation may have a thickness of from 30 μm to 200 μm, such as from 40 μm to 120 μm, such as 80 μm;

(f) the high-temperature insulated metal wire may have a resistance of from 0.1 to 20 Ohms/metre (e.g. from 0.2 to 1 Ohms/metre);

(g) the conductive wire is laid in a zig-zag or sinusoidal pattern through the wire-containing region of the warp-knitted yarn;

(h) the conductive wire may be a plurality of wires in each wire containing region, optionally wherein the number of wires is from 1 to 180, such as from 2 to 50, such as 4 to 10, optionally wherein the plurality of wires are laid to form connection nodes within the fabric;

(i) the composite material comprises the whole or part of a garment, an accessory, an electrical conduit, a house decoration and vehicle upholstery.

In a third aspect of the invention, there is provided a composite material comprising a substrate and the wire-containing region of the composite material of the second aspect of the invention and any technically sensible combination of its embodiments.

In a fourth aspect of the invention, there is provided a process to form a composite material according to the first and second aspects of the invention and any technically sensible combination of their respective embodiments, which process comprises the use of warp-knitting.

In a fifth aspect of the invention, there is provided a process to form a composite material according to the third aspect of the invention and any technically sensible combination of its embodiments, which process comprises the steps of placing a composite material of the according to the second aspect of the invention and any technically sensible combination of its embodiments onto a substrate, applying heat and removing the non-wire-containing regions.

Further aspects and embodiments of the invention are supplied by the numbered clauses below.

1. A composite material comprising:

a high-temperature insulated metal wire; and an elastic yarn, wherein the conductive wire is spirally-wrapped around the elastic yarn.

2. The composite material of Clause 1, wherein the high-temperature insulated metal wire is a wire that comprises a core metal wire and a high-temperature insulation coating material, optionally wherein the total diameter of the high-temperature insulated metal wire is from 0.10 mm to 3.00 mm, such as from 0.15 mm to 1.00 mm, such as from 0.20 mm to 0.40 mm (e.g. 0.22 mm or 0.39 mm).

3. The composite material of Clause 2, wherein the high-temperature insulation coating material is selected from one or more of the group selected from teflon, PET, fiberglass, silicone rubber, nylon, ethylene propylene rubber (EPR), and natural rubber, optionally wherein the high-temperature insulation coating material has a thickness of from 30 μm to 200 μm, such as from 40 μm to 120 μm, such as 80 μm.

4. The composite material of Clause 2 or Clause 3, wherein the core metal wire is formed from multiple wirelets, each having a diameter of from 5 μm to 200 μm (e.g. from 15 μm to 150 μm, such as from 25 μm to 50 μm).

5. The composite material of Clause 4, wherein there are from 4 to 50 wirelets (e.g. from 10 to 45 wirelets, such as from 15 to 30 wirelets).

6. The composite material of Clause 4 or Clause 5, wherein the core metal wire formed from the multiple wirelets has a diameter of from 0.10 mm to 1.50 mm (e.g. from 0.12 to 1.00 mm, such as from 0.14 mm to 0.3 mm).

7. The composite material of any one of the preceding clauses, wherein the metal of the core metal wire is selected from one or more of the group selected from nickel or, more particularly, copper, silver, gold, and stainless steel, optionally wherein, when the core metal wire is formed from multiple wirelets, each wirelet is coated with one or more of the group selected from nickel or, more particularly, tin, gold, silver and stainless steel.

8. The composite material of any one of the preceding clauses, wherein the high-temperature insulated metal wire further comprises a polymeric core material (e.g. nylon) surrounded by the metal wire, optionally, wherein the total diameter of the high-temperature insulated metal wire comprising the polymeric core material is from 0.15 mm to 3.50 mm, such as from 0.25 mm to 1.00 mm, such as from 0.30 mm to 0.50 mm (e.g. 0.39 mm).

9. The composite material of any one of the preceding clauses, wherein the high-temperature insulated metal wire has a resistance of from 0.1 to 20 Ohms/metre (e.g. from 0.2 to 1 Ohms/metre).

10. The composite material of any one of the preceding clauses, wherein the composite material is used to form the whole or part of a garment, an accessory, an electrical conduit, a house decoration, vehicle upholstery (e.g. products formed by knitting, weaving or embroidery).

DRAWINGS

Embodiments of the invention will now be described, by way of non-limiting example only, with reference to the accompanying drawings.

DESCRIPTION

Figure 1:
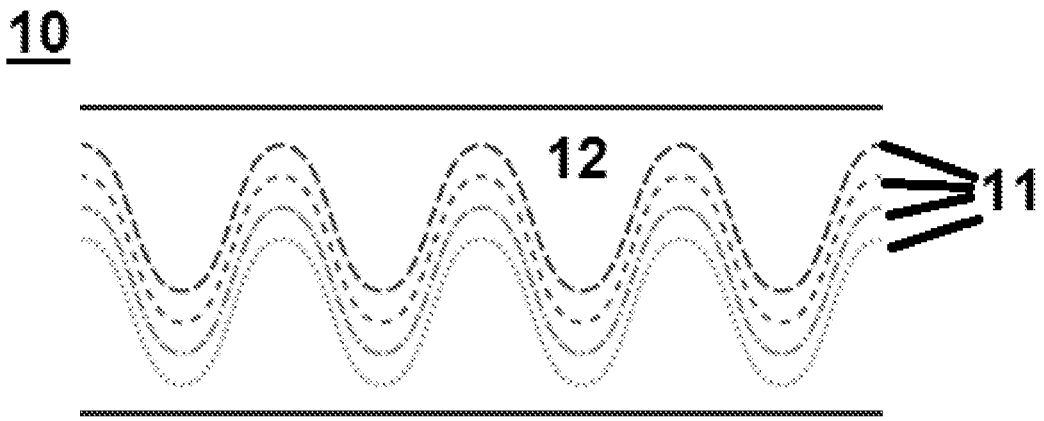
FIGS. 1-3 and 5-6 depict embodiments according to a first aspect of the current invention.

Certain embodiments of the present invention provide means of creating in-fabric conductive paths suitable for affixing to stretchable textile substrates and/or to form said stretchable textile substrates themselves. Further embodiments of the present invention provide means of creating conductive paths on stretchable textile substrates. These embodiments address one or more of the disadvantages and limitations of prior art methods discussed above.

Embodiments of the invention relate to the formation of conductive paths, either directly within textiles or apparel, amongst other things, or in a flexible substrate that may be affixed to textiles or apparel, amongst other things. Additional embodiments of the invention relate to making a conductive path on textiles or apparel. The conductive paths described herein enable textiles or apparel to be used for smart clothing for various applications including sports, well-being, illumination, heating, communication, health-care monitoring etc. In certain embodiments, an intermediate product may be manufactured that affixes a flexible fabric-based conductive path constructed in accordance with an embodiment of the current invention directly onto a substrate through the use of heat. Embodiments may provide for the application of a conductive path to only one side of the textile substrate, with no tangible or visible modification to the other side of the textile substrate. Further embodiments may provide for the application of a conductive path within the textile substrate itself, with no tangible or visible modification of the textile substrate.

Thus, in a first aspect of the invention, there is provided a conductive wire and a yarn, wherein the yarn forms a warp-knitted fabric containing loops and the conductive wire is laid in a pattern that passes through the loops of the warp-knitted fabric, such that a locking stretch of the yarn within the warp-knit fabric is less than the pattern stretch of conductive wire.

When used herein, the term "yarn" unless explicitly stated otherwise relates to any conventional yarns that may be used in the manufacture of a product for use in apparel or industry. Such yarns may use materials that are natural or synthetic in nature and include, but are not limited to, alpaca, angora, cashmere, cotton, flax, hemp, jute, llama, mohair, piña, ramie, silk, sisal, wool, acrylic, aramid, carbon fiber, nylon, polyester, rayon and spandex and blends thereof.

The resulting composite material provides enhanced breathability and enables a conventional metal wire to withstand the bending, stretching, drapability, flexibility and washability requirements associated with garments and other products of interest (e.g. an accessory, an electrical conduit, a house decoration and vehicle upholstery). These properties may be further enhanced when the high-temperature insulated wire is used as the conductive wire, which embodiments are disclosed hereinbelow.

Warp-knitting is a standard machine-based fabrication technique for flexible fabrics and warp-knitting machines can lay one (or more) set(s) of yarns within another set of yarns that are used to form loops in the warp-knit fabric. Given this, it is possible to lay a conductive wire within the warp-knit fabric in such a way that the conductive wire is embedded and hidden within the fabric so that the wire cannot be seen or felt when inspecting the fabric, thus the warp-knit fabric discussed herein may be used as the basis of a garment itself, or it may be applied to a substrate to provide a flexible product with minimal restriction in movement or in the desired properties of the garment. In addition, warp-knitting may lay the wire in a non-linear path, which will be discussed in more detail below.

It will be appreciated that any suitable warp-knitting machine may be used to produce the product disclosed herein. As a non-limiting example of a suitable machine, a Karl Mayer warp-knitting machine available from Noyon Lanka may be used. Said machine is capable of providing a wire that can travel a single yarn at a 17 cm gap and can lay down up to 180 wires in parallel. This may enable the laying of complex patterns within the fabric as discussed in more detail hereinbelow.

When used herein "warp-knitted fabric" may be any fabric that can be provided by warp-knitting. This may include tricot knit fabrics, raschel knit fabrics, crochet knit fabrics and Milanese knit fabrics. A suitable warp-knit fabric that may be mentioned herein includes lace.

Warp knitted fabrics of the kind prepared herein may be suitable for use in garments (such as, but not limited to, inner wear (e.g. brassieres, panties, camisoles, girdles, sleepwear, hook & eye tape and the like), apparel (e.g. sportswear lining, track suits, leisure wear and safety reflective vests and the like) and shoes (e.g. inner lining and inner sole lining in sports shoes and industrial safety shoes and the like), accessories (e.g. bags, hats, gloves and the like), household items (e.g. mattress stitch-in fabrics, furnishings, laundry bags, mosquito nets, aquarium fish nets, curtains and the like), automotive (car cushion, head rest lining, sun shades and lining for motorbike helmets and the like), aerospace/nautical (conductive pathways in aircraft and ships) and industry (pvc/pu backings, production masks, caps and gloves).

The fabric of the composite material is engineered so that the maximum stretch (locking stretch) is less than the stretch of the pattern used for the conductive wire, such that the wire is protected from high stretch forces being directly applied to it even when the composite material is over-stretched during manufacture or under normal use (e.g. snagging of a garment while running or when a garment is subjected to machine washing). In addition, the pattern of the fabric itself helps to keep the pattern of the conductive wire fixed and unchanged within the fabric even during these extreme movements. Thus, the composite material provides substantial mechanical protection to the conductive wire, but at substantially reduced processing and material costs with regard to the other methods discussed hereinbefore. In addition, the method used to manufacture the product makes use of readily available technology to provide these fabric-based conductive pathways, resulting in substantial capital savings as it is possible to use conventional machinery.

In certain embodiments of the composite material described hereinbefore, the conductive wire may be a high-temperature insulated metal wire that comprises a metal wire and a high-temperature insulation coating material. In alternative embodiments of the composite material described hereinbefore, the conductive wire may comprise a high-temperature insulated metal wire and an elastic yarn, wherein the conductive wire is spirally-wrapped around the elastic yarn.

When used herein "high temperature insulated" means that the insulation is capable of withstanding at least 150° C. at 1 atmosphere pressure without melting, such as at least 250° C. at 1 atmosphere pressure up to a maximum of around 300° C. at 1 atmosphere pressure. Suitable materials for the high-temperature insulating coating material include, but are not limited to one or more of the group selected from PTFE, PET, fiberglass, silicone rubber, nylon, ethylene propylene rubber (EPR), and natural rubber. The thickness of the insulation material may be from 30 μm to 200 μm, such as from 40 μm to 120 μm, such as 80 μm.

The use of the high-temperature insulation material to cover the wire allows these thin wires to withstand high temperature and pressure conditions that fabrics may be subjected to in manufacturing and use—these conditions can easily go up to 200° C. and 3 bar pressure. While the use of the high temperature insulation material means that the wires can survive high temperatures, it will be appreciated that heat generated by the wires may escape through the insulation into the environment. As such, the high insulation wires described herein may be suited for use in heating applications, as described in more detail hereinbelow.

A further advantage associated with the use of these high-temperature insulated metal wires in the composite materials of the current invention is that it enables the use of wires that have a much higher conductivity than can be conventionally used in such applications. For example, the metal wire used in the high-temperature insulated metal wire may have a resistance of from 0.1 to 20 Ohms/metre (e.g. from 0.2 to 1 Ohms/metre) in comparison to conventional conductive wire/yarns, which typically have a resistance of around 60 Ohms/metre. This may enable the composite materials discussed hereinbefore to be used in high-power applications, with less power loss than is possible with conventional conductive pathways. In conventional conductive pathways, the wires are insulated using layers of insulating material to encapsulate the wiring system, making them very bulky leading to discomfort to a wearer when affixed to a garment. If higher-conductivity wires were used in these conventional conductive pathways, the thickness of the insulation layers would need to be increased further, leading to greater discomfort on the part of the user due to the increase in bulk of the material.

Figure 5:
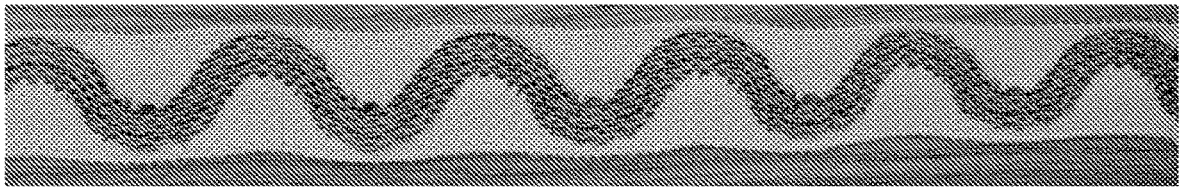
Figure 6:
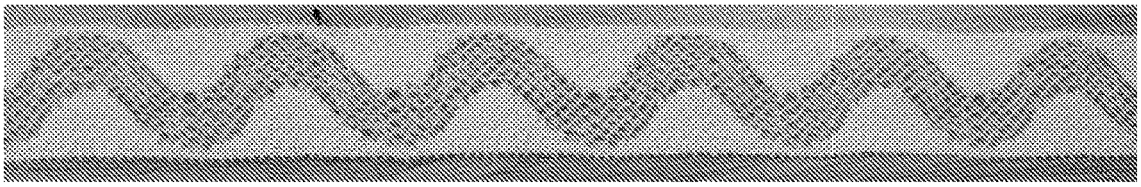

In certain embodiments of the invention, the high-temperature insulated metal wire does not contain additional components that may increase the overall diameter of the insulated wire. In this case, the total diameter (including insulation) of the high-temperature insulated metal wire may be from 0.10 mm to 3.00 mm, such as from 0.15 mm to 1.00 mm, such as from 0.20 mm to 0.25 mm (e.g. 0.22 mm). In alternative embodiments, the high-temperature insulated metal wire may further comprise a polymeric core material surrounded by the metal wire, which is in turn clad in the high temperature insulation material. In this case, the total diameter (including insulation) of the high-temperature insulated metal wire comprising the polymeric core material may be from 0.15 mm to 3.50 mm, such as from 0.25 mm to 1.00 mm, such as from 0.30 mm to 0.50 mm (e.g. 0.39 mm). The use of the polymeric core may provide greater flexibility and durability to the high-temperature insulated wire. The use of a polymeric core material is depicted in FIG. 5, where four high-temperature wires containing a polymeric core of nylon are laid in a sinusoidal pattern within a lace yarn. As the inclusion of the high-temperature wires makes these wires larger in diameter, it may be possible to observe them in a lace fabric, but the fabric can be arranged to ensure that these fibres are hidden. In contrast, the four high-temperature wires depicted in FIG. 6 are almost entirely hidden to a casual observer within the same lace structure used in FIG. 5.

When a polymeric core is used in embodiments of the invention using a high-temperature insulated metal wire, the polymeric core may be nylon. In certain embodiments that may be mentioned herein, the polymeric core is formed as a plurality of yarnlets, optionally wherein there are from 20 to 500 yarnlets (20 D to 500 D), for example, from 50 to 300 yarnlets (50 D to 300 D), such as 150 yarnlets (150 D).

In embodiments of the invention where a high-temperature insulated metal wire is used, the metal wire may be formed from a plurality of wirelets, each having a diameter of from 5 μm to 200 μm (e.g. from 15 μm to 150 μm, such as from 25 μm to 50 μm). For example, the metal wire may be formed by from 4 to 50 wirelets, such as from 10 to 45 wirelets or from 15 to 30 wirelets. It will be appreciated that the wirelets may be arranged in any suitable filling pattern to provide the resulting metal wire. For example, if 50 wirelets of 200 μm diameter are arranged in a circular filling pattern, then the diameter of the resulting wire will be 3 mm and when 4 wirelets of 200 μm diameter, they may be arranged in a filling pattern to provide a 450 μm diameter.

In embodiments of the invention where the metal wire is formed from a plurality of wirelets, the metal wire may have a diameter (excluding insulation) of from 0.10 mm to 1.50 mm (e.g. from 0.12 to 1.00 mm, such as from 0.14 mm to 0.3 mm).

In embodiments of the invention, the metal wire (whether in wirelet form or otherwise), may be selected from one or more of the group selected from nickel or, more particularly, copper, silver, gold, stainless steel, and alloys thereof. In certain embodiments of the invention when the metal wire is formed from a plurality of wirelets, each metal wirelet may be coated with one or more of the group selected from nickel or, more particularly, tin, gold, silver, stainless steel and alloys thereof—it will be apparent that the metal coating the wirelet should preferably be different to the metal of the wirelet itself, though this may not always be the case. In certain embodiments of the invention that may be mentioned herein, the metal wirelets may be formed from copper and coated in tin.

Figure 2:
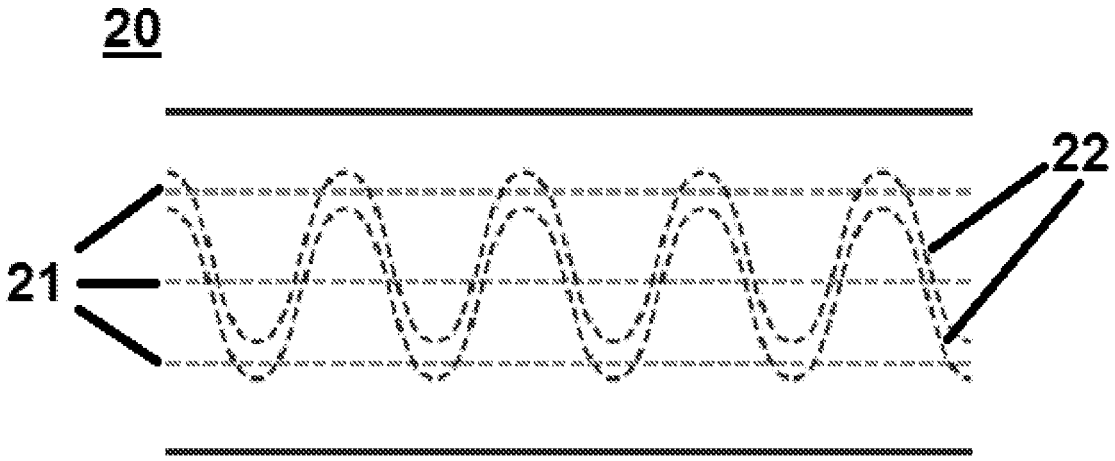

In certain embodiments, it may be desired to bond the composite material to a substrate material, for example to a fabric substrate or to a metallic substrate and the like. In these embodiments, the composite material further comprises one or more bonding yarns incorporated into the fabric and lying substantially on a top and/or bottom surface of the fabric. As will be appreciated, given that the purpose of these bonding yarns is to secure the composite material to a further substrate a sufficient proportion of the bonding yarn needs to be present on a surface (or surfaces) of the composite material to ensure that the material forms a strong bond to the surface of the substrate (or substrates) to which it is bonded. Suitable bonding yarns that may be mentioned include fusible bonding/adhesive yarns made from low-melt nylon, Co-PA (copolyamide) and low-melt polyester, Co-PES (copolyester) multifilaments, such yarns include GRILON™ fusible bonding/adhesive yarns. A depiction of a fabric 20 having three bonding yarns 21 within the fabric is shown in FIG. 2 where the top surface (shown) contains part of the bonding yarns and the bottom surface (not shown) contains substantially the remainder of the bonding yarns, with conductive wires 22 laid in a sinusoidal pattern.

When used herein, "low-melt" and "bonding yarn" refers to a material where part of the material melts at a temperature of from 100 to 180° C. at 1 atm. It will be appreciated that the low-melt and high-temperature materials mentioned herein will be deliberately selected to ensure sufficient temperature separation to ensure that the high temperature coatings do not suffer from melting when a low-melting bonding yarn is used. For example, the difference in the melting temperatures of these materials will be at least 10° C., such as from 20 to 50° C. or more.

In alternative embodiments of the invention, the conductive wire may be an uninsulated wire that is selected from one or more of the group selected from nickel or, more particularly, copper, silver, gold, and stainless steel, silver coated nylon, and a conductive carbon-containing yarn. It will be appreciate that alloys of the listed metals may be used. The uninsulated conductive wire may be coated with one or more of nickel or, more particularly, tin, gold, silver or stainless steel. The total diameter of the uninsulated wire may be from 0.05 mm to 3.00 mm, such as from 0.15 mm to 1.00 mm, such as from 0.20 mm to 0.40 mm (e.g. 0.22 mm or 0.39 mm). In embodiments where the uninsulated wire does not require an insulation layer, then the advantages associated with breathability and increased: bending, stretching, drapability, flexibility and washability also apply to these composite materials.

Again, the uninsulated wires described herein may be suited for use in heating applications as described hereinbelow.

In certain embodiments, the uninsulated wire may require insulation and so one or more insulation layers are applied over the composite material to cover the uninsulated wires. While the use of these insulation layers removes the improved breathability advantages discussed hereinbefore, there remain advantages associated with increased: bending, stretching, drapability, flexibility and washability for these composite materials due to the increased mechanical protection provided to the conductive wire by its integration into the yarn.

As noted hereinbefore, the products of the first aspect of invention include conductive wires laid in a pattern within the fabric. Any suitable pattern that helps to protect the conductive wire from being exposed to excessive mechanical forces may be used in conjunction with the lock stitch. Examples of this include a zig-zag pattern and a sinusoidal pattern through the warp-knitted yarn 10, the latter is depicted in FIG. 1, where four conductive wires 11 are laid within the fabric 12. Similar arrangements are depicted in the pictures of FIGS. 5 and 6 using four nylon-core high temperature wires and found high temperature wires without a nylon core, respectively.

Any other suitable arrangement of the conductive wires is contemplated. For example, the wires may be arranged in any serpentine pattern within the fabric which allows the wire to elongate along any direction of the fabric, most particularly elongation in the direction of the length of the fabric.

Figure 3A:
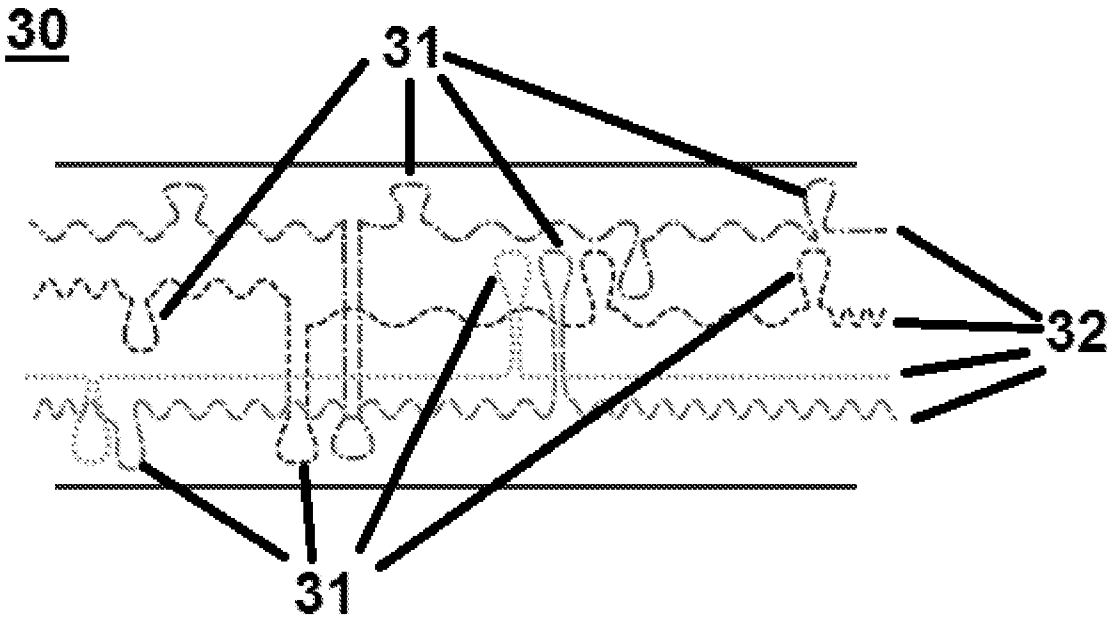
Figure 3B:
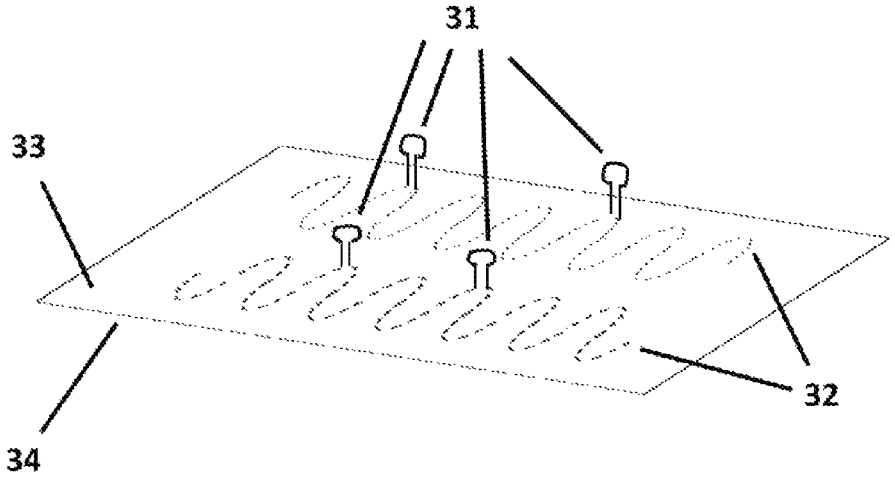
Figure 3C:
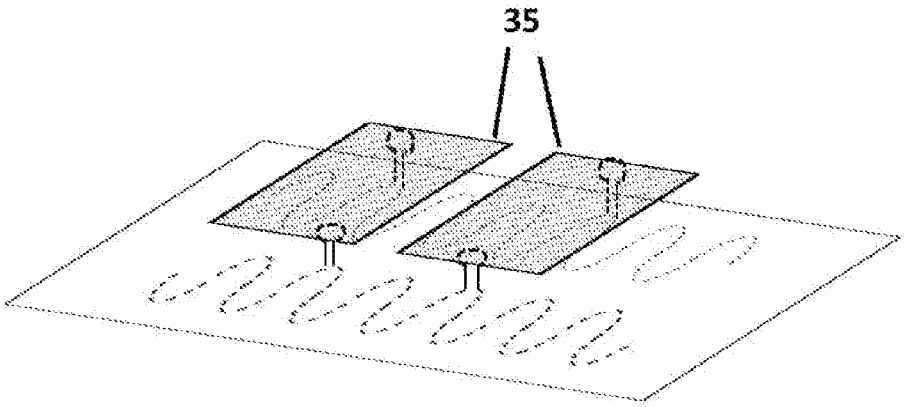

As will be appreciated from the above, more than one conductive wire may be laid within the fabric. This can be up to the limit of the machine used to produce the fabric. Given this, the number of conductive wires that may be laid within the fabric may be from 1 to 180, such as from 2 to 50, such as 4 to 10. It will be appreciated that the use of one or more wires laid with a pattern within a fabric 30 may enable the formation of connection nodes within the fabric and that when more than one conductive wire 32 is used, these connection nodes may be used to provide a complex circuitry within the fabric, as depicted in FIGS. 3A to 3C. This circuitry may be used to enable a number of devices to be attached to the fabric and be powered therefrom. Such devices may include sensors, power sources, lighting devices and microcontrollers, though any suitable electronic device may be used.

As depicted in FIG. 3A, the wires 32 may be overlaid on top of one another to create various circuit connections (e.g. when using uninsulated wire or wire that is partly uninsulated at areas where the wires overlap). In addition, connection nodes 31 are formed in the fabric by allowing the conductive wire to exit the plane of the fabric (best seen in FIGS. 3B and 3C) on either the top 33 or the bottom 34 surface to allow the connection of circuit boards 35 to the fabric (see FIG. 3C). Intermittently insulated wires may be prepared by stripping the insulation from the wire manually (e.g. to create the connection node 32) or through the use of a suitable method, such as described in PCT Patent Application No. PCT/SG2016/05058, which is herein incorporated by reference.

As will be appreciated, the composite material disclosed hereinbefore may itself form the whole of a product, or it may form part of a product. Such products include, but are not limited to a garment, an accessory, an electrical conduit, a house decoration (e.g. curtains, bed sheets etc.), and vehicle upholstery. For example, with reference to a garment, the garment may be entirely constructed from the composite material disclosed herein or part of it may be constructed from said fabric. When part of the garment is constructed from the composite material, this may be in the form of a garment panel that is added to other garment panels to construct the finalised garment. Alternatively, or additionally, the composite material may be bonded to a garment substrate (e.g. in an inner or outer portion of the garment) by any suitable method, which includes, but is not limited to stitching and the use of adhesives and the like (e.g. via use of a bonding yarn as discussed hereinbefore). Similar arrangements apply to the other discussed herein.

Figure 7:
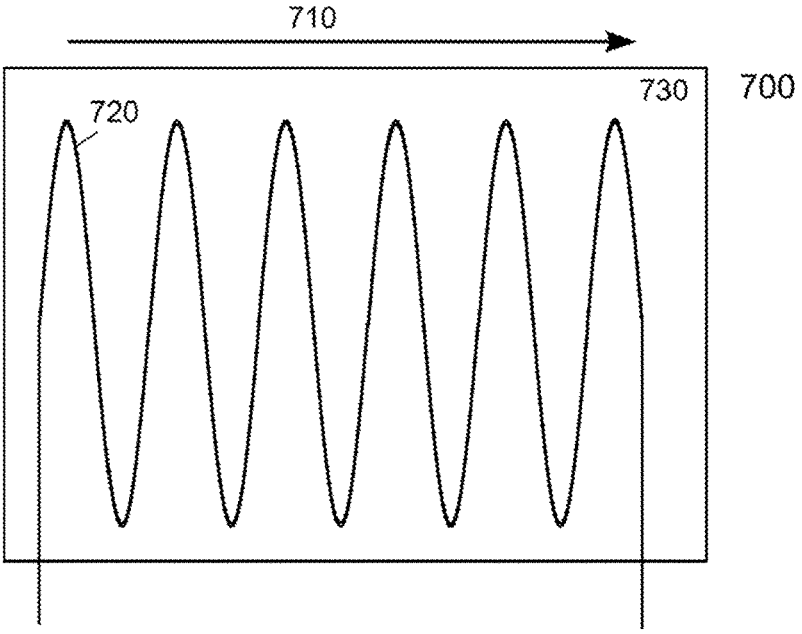
FIGS. 7-10 depict various arrangements of heating panels that may be used in the current invention.

FIGS. 7 to 10 depict various arrangements of the first aspect of the invention that may be particularly useful in heating applications. FIG. 7 depicts a general heating panel 700, wherein the arrow 710 depicts the direction of knitting and a single conductive wire 720 is shown having a sinusoidal arrangement within fabric 730, where the amplitude and wavelength of the sinusoidal arrangement are provided so as to provide the desired thermal requirement of the heating application to which the fabric is to be applied (e.g. heating a part of a human body).

Figure 8:
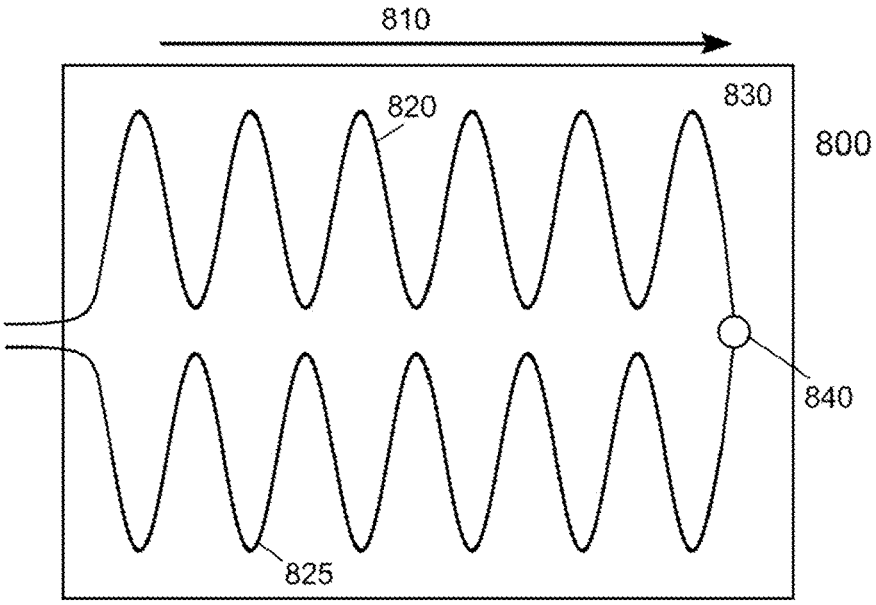

As will be appreciated, there is a maximum amplitude to the sine wave that may be laid down within the material (e.g. up to 15 cm). In order to overcome this limitation, two (or more) sine wave patterns may be laid down side-by-side in the manner depicted in FIG. 8, where arrow 810 depicts the knitting direction. In FIG. 8, the heating panel 800 comprises two conductive wires 820 and 825 laid in a side-by-side manner in order to effectively double the height of the heating panel within fabric 830. The conductive wires 820 and 825 are brought into conductive contact with one another by means of an interconnect 840.

Figure 9:
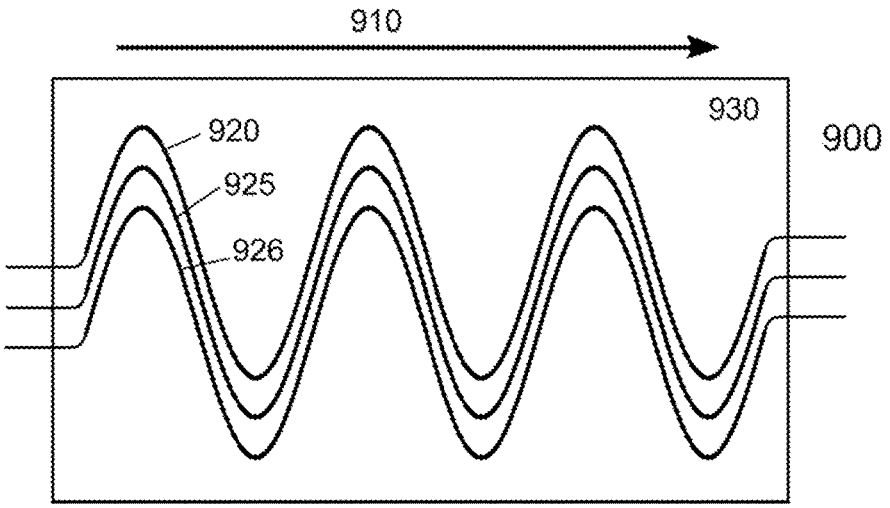

In other embodiments of the first aspect of the invention, it is possible to laydown multiple conductive wires parallel to one another, as depicted in FIG. 9, where arrow 910 depicts the knitting direction. As shown in FIG. 9, three conductive wires 920, 925 and 926 are laid in parallel sine wave patterns to increase the density of heating wires within the fabric 930.

Figure 10:
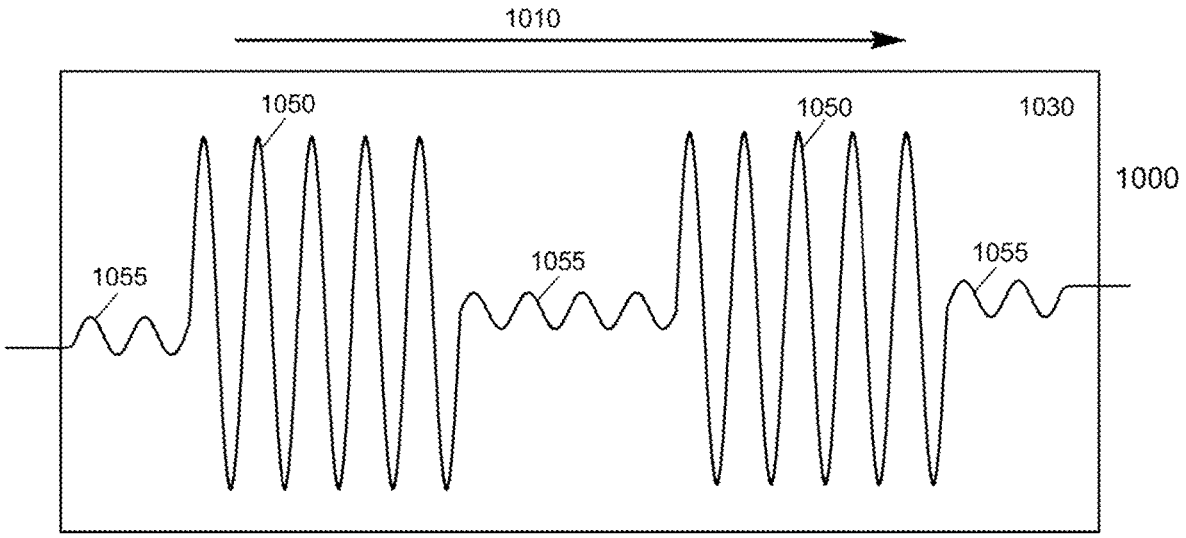

As will be appreciated, it may be desired to have two or more regions of heating areas. With that in mind, one arrangement that may be adopted is depicted in FIG. 10, where arrow 1010 depicts the knitting direction. In FIG. 10, there is a single conductive wire 1020 (though the above arrangements involving multiple wires described in FIGS. 8 and 9 may be used), where the wire is laid down in such a way that certain portions have a greater sinusoidal amplitude 1050 than other portions of the wire 1055 in fabric 1030.

In a second aspect of the invention, there is provided a composite material comprising:

at least one insulated conductive wire; and a warp-knitted fabric containing loops formed from a non-heat soluble yarn and a heat-soluble yarn, wherein one or more wire-containing regions are formed in the warp-knitted fabric, where each wire-containing region is defined by a first non-heat soluble yarn thread at a first position and by a second non-heat soluble yarn thread at a second position, and the at least one conductive wire is laid in a pattern that passes through the loops of the warp-knitted fabric in one of the at least one or more wire-containing regions such that a locking stretch of the yarn within the warp-knit fabric is less than the pattern stretch of the conductive wire.

Unless explicitly stated otherwise like terms used in the second aspect correspond to the definitions provided hereinbefore for the first aspect of the invention.

Figure 4:
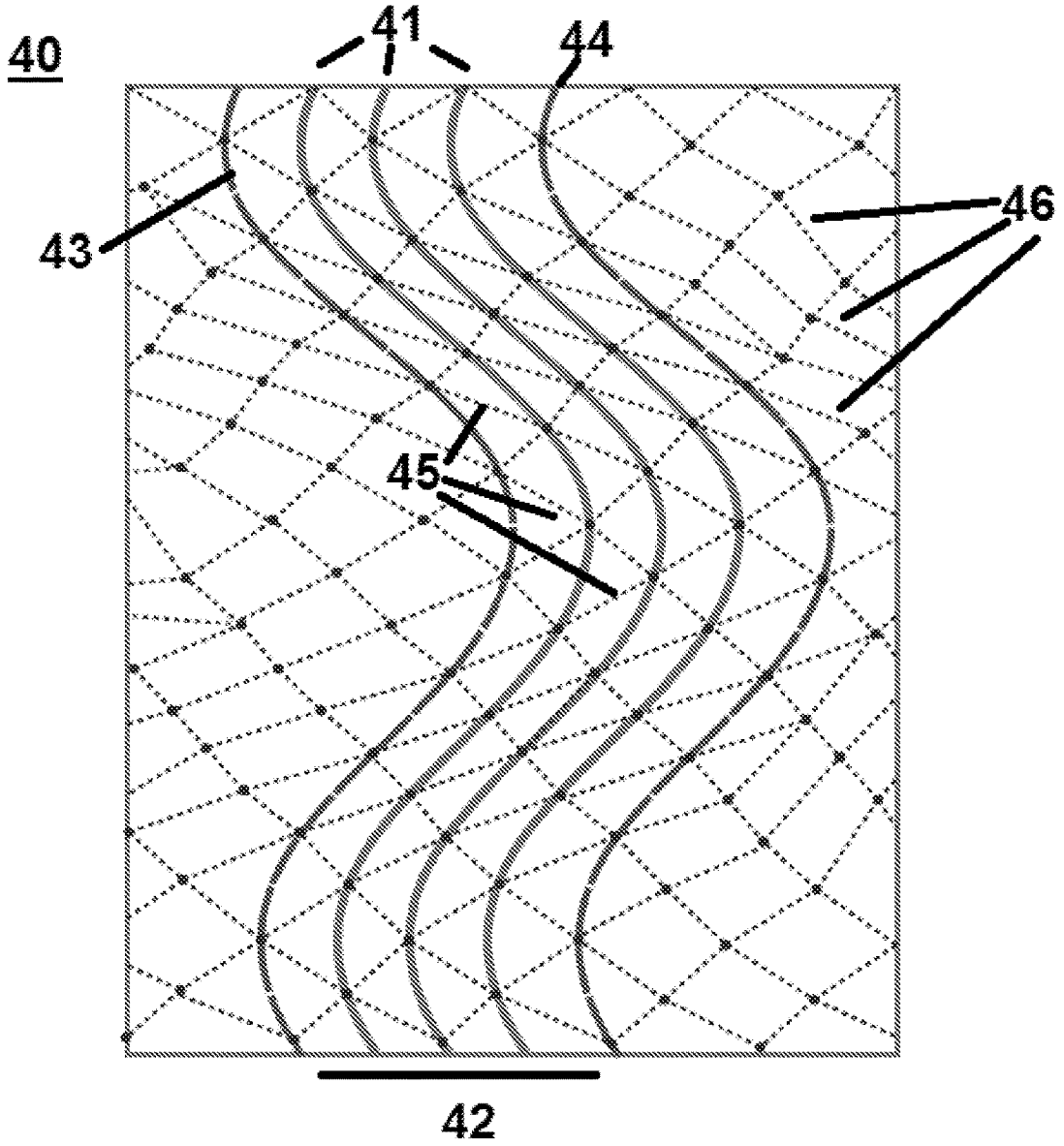
FIG. 4 depicts an embodiment in accordance with the second and third aspects of the current invention.

The above aspect of the invention differs from the previous aspect of the invention in that heat-soluble yarns are included in the manufacture of the fabric component of the composite material. The intent of these heat soluble yarns is to create regions within the fabric that are designed to house the insulated wires. An embodiment having this arrangement is depicted in FIG. 4, where there are four insulated wires 41 held within a wire-containing region 42 defined by two heat-soluble yarns 43, 44. When this composite material 40 is applied to a substrate and heat is applied, the heat-soluble yarns dissolve (or melt completely) and the fabric 43 outside the wire-containing region(s) can be removed, while leaving the wire-containing region in place. As shown in FIG. 4, the fabric 42 within the wire containing region may contain a fusible yarn 45 (e.g. Grilion™ yarn as described herein before)—this fusible yarn may form the entirety of the warp-knit fabric within the wire-containing region or it may form part—that is, there may be a mixture of fusible yarns and convention yarns, such as nylon. Outside the wire containing region 42, the warp-knit fabric may be composed of a conventional fabric (e.g. nylon) 46. In certain embodiments, it may not be necessary to use a fusible yarn in the wire-containing region. This is because the insulation material on the insulated wire may itself be fusible in part (e.g. it may be made from TPC or other fusible coating materials), such that the application of heat adheres the wires and the fabric to the substrate and dissolves the heat-soluble yarns thereby allowing the remainder of the fabric to be removed from the substrate. While the composite material may be applied to a further substrate in the manner described hereinabove, it is not essential as the composite material may be used in the manner described hereinbefore for the first aspect of the invention.

However, the above aspect has many features in common with the first aspect of the invention, including the use of a locking stretch within the fabric to protect the wires from mechanical forces, but still providing greater breathability and flexibility etc. that would otherwise be possible with conventional fabrics used in wearable technology. The conductive wire may be laid in a zig-zag or sinusoidal pattern (as shown in FIG. 4) through the wire-containing region of the warp-knitted yarn, though any suitable pattern is possible as discussed hereinbefore. FIG. 4 also shows that the second aspect of the invention may contain more than one conductive wire, as it shows that four conductive wires may be used. In keeping with the first aspect of the invention, there may be as many conductive wires within the composite material as is possible to include, such as from 1 to 180 wires, such as from 2 to 50, such as 4 to 10. It will be appreciated that these wires may be laid to form connection nodes within the fabric as discussed hereinbefore for the first aspect of the invention.

When used herein "insulated wire" may refer to any type of insulated wire and expressly includes the high-temperature wires described hereinbefore in the first aspect of the invention (with or without a nylon core). In addition, and as mentioned above, "insulated wire" may refer in certain embodiments of the second aspect of the invention to a fusible insulation coating material (e.g. that may part-melt upon exposure to a heat source at an elevated temperature—such as a fusible TPC) that can therefore form an adhesive bond between a substrate material and the fabric. The insulation material may have a thickness of from 30 μm to 200 μm, such as from 40 μm to 120 μm, such as 80 μm.

When used herein, a "heat-soluble yarn" is a thread or yarn that can dissolve or entirely melt upon application of heat at the required temperature, for example during processing of the composite material into a final product.

The insulated conductive wire may be selected from one or more of the group selected from nickel or, more particularly, copper, silver, gold, and stainless steel, silver coated nylon, and a conductive carbon-containing yarn, optionally wherein the uninsulated wire is coated with one or more of nickel or, more particularly, tin, gold, silver or stainless steel. Alloys of the metals mentioned herein are also explicitly covered. The insulated conductive wire may have a total diameter of from 0.10 mm to 3.00 mm, such as from 0.15 mm to 1.00 mm, such as from 0.20 mm to 0.40 mm (e.g. 0.22 mm or 0.39 mm).

In keeping with the first aspect of the invention, embodiments of this second aspect of the invention may be capable of providing wires having higher than conventional conductivities. For examples, the insulated conductive wire may have a resistance of from 0.1 to 20 Ohms/metre (e.g. from 0.2 to 1 Ohms/metre).

In keeping with the first aspect of the invention, the composite material of the second aspect of the invention may form the whole or part of a garment, an accessory, an electrical conduit, a house decoration, and vehicle upholstery. In addition, if the heat-soluble yarn is dissolved, it will be appreciated that the wire-containing region of the composite material described hereinbefore may be deposited on any suitable substrate (e.g. including, but not limited to a polymeric substrate, a metal, and a fabric).

The conductive wires used herein (in the first aspect or second aspect of the invention and their embodiments), whether insulate or uninsulated, may be arranged within a yarn structure to further obscure them from view of the user or an observer. Two examples of such arrangements are provided in FIGS. 11 and 12.

Figure 11:
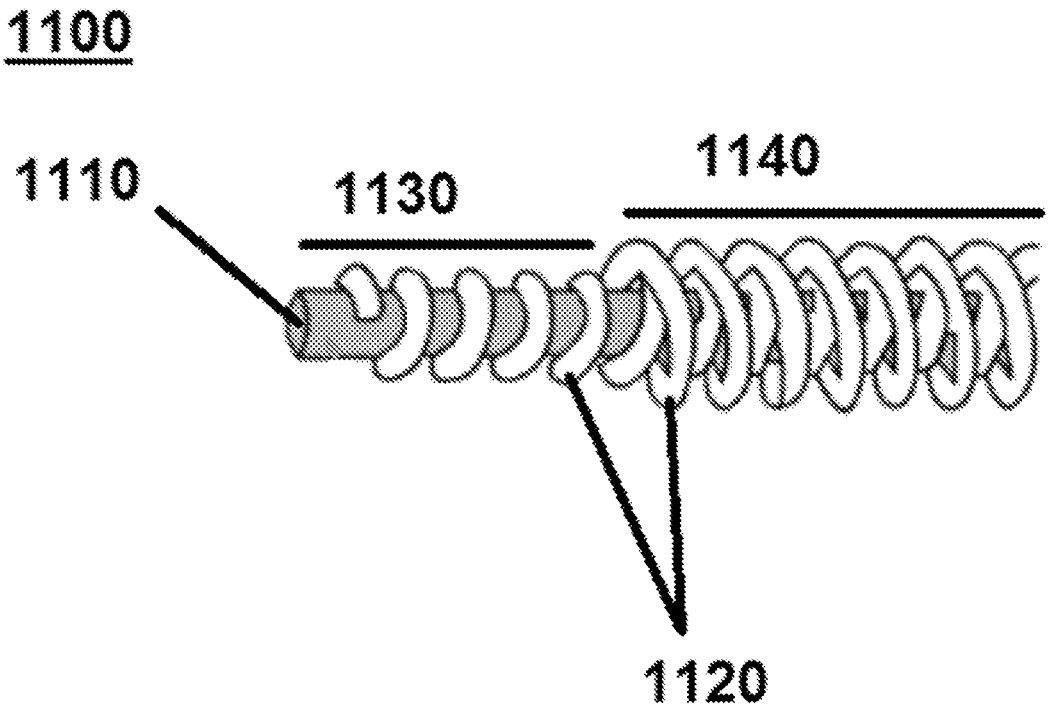
FIG. 11 depicts a conductive wire covered in a non-conductive yarn, which may be used in aspects and embodiments of the current invention.

FIG. 11 depicts a yarn-covered conductive wire 1100, where a conductive wire 1110 suitable for use in to any of the embodiments described above has been wrapped in a covering yarn material 1120 in a single covering (region 1130) or a double covering (region 1140). When used herein, a "single covering" as used herein refers to the wrapping of a yarn around a conductive wire from one end to the other end in a single pass. A "double covering" may relate to the use of two yarns to cover a conductive wire from one end to the other end in a single pass, or it may relate to the same yarn returning to the starting end in a second pass. Other covering levels (e.g. triple and quadruple, if used, may be construed accordingly).

Figure 12:
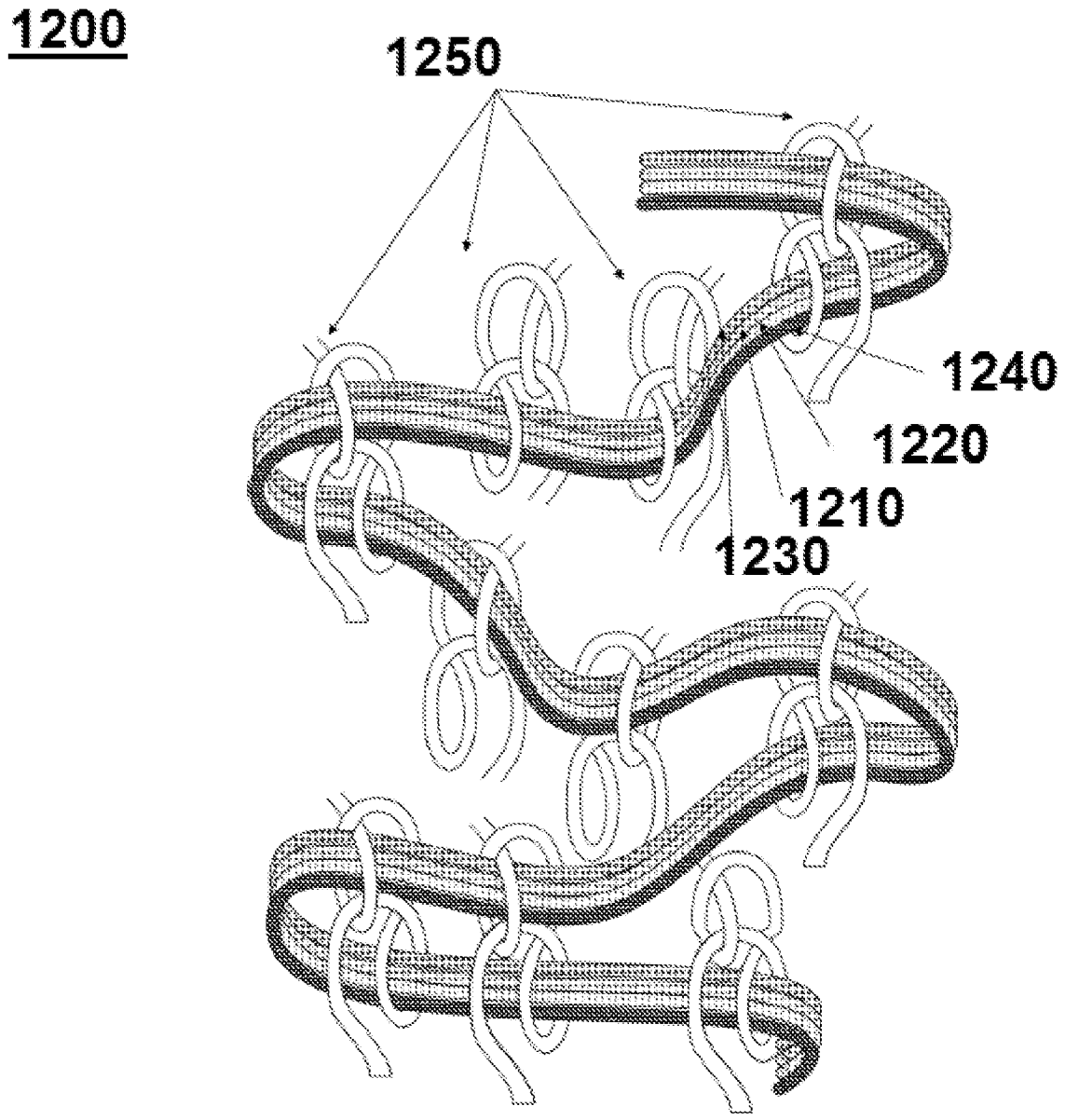
FIG. 12 depicts a hidden conductive wire arrangement that relates to the first aspect of the invention and its embodiments.

FIG. 12, which relates to the first aspect of the invention and its embodiments, depicts a further means of making the conductive wire essentially invisible to an observer. In this case, the conductive wire 1210, is sandwiched between two pattern yarns 1220 and 1230, with the first pattern yarn 1220 being itself sandwiched between the conductive yarn 1210 and a jacquard yarn 1240. The collective yarns 1210-1240 run in a sinusoidal pattern through pillar yarns 1250 of the warp-knit fabric 1200. This arrangement allows a jacquard pattern and texture to be applied at least to the regions containing a conductive wire within the fabric and thus helps to completely obscure the presence of the conductive wire from observation.

The invention claimed is:

1. A composite material comprising:

a conductive wire; and a yarn, wherein:

the yarn forms a warp-knitted fabric containing loops and the conductive wire is laid in a pattern that passes through the loops of the warp-knitted fabric, such that a locking stretch of the yarn within the warp-knit fabric is less than the pattern stretch of the conductive wire; and the composite material further comprises one or more bonding yarns incorporated into the fabric and lying substantially on a top and/or bottom surface of the fabric.

2. The composite material of claim 1, wherein the conductive wire is a high-temperature insulated metal wire that comprises a metal wire and a high-temperature insulation coating material.

3. The composite material of claim 1, wherein the conductive wire comprises:

a high-temperature insulated metal wire; and an elastic yarn, wherein the conductive wire is spirally-wrapped around the elastic yarn.

4. The composite material of claim 2, wherein the metal wire is formed from a plurality of wirelets, each having a diameter of from 5 μm to 200 μm.

5. The composite material of claim 4, wherein there are from 4 to 50 wirelets or the metal wire formed from the plurality of wirelets has a diameter of from 0.10 mm to 1.50 mm.

6. The composite material of claim 2, wherein the high-temperature insulated metal wire further comprises a polymeric core material surrounded by the metal wire.

7. The composite material of claim 1, wherein the conductive wire is an uninsulated wire that is selected from one or more of the group selected from nickel, copper, silver, gold, and stainless steel, silver coated nylon, and a conductive carbon-containing yarn.

8. The composite material of claim 1, wherein the conductive wire is laid in a zig-zag or sinusoidal pattern through the warp-knitted yarn.

9. The composite material of claim 1, wherein the conductive wire is a plurality of wires.

10. The composite material of claim 9, wherein the plurality of wires are laid to form connection nodes within the fabric.

11. The composite material of claim 1, wherein the composite material comprises the whole or part of a garment, an accessory, an electrical conduit, a house decoration, and vehicle upholstery.

12. A composite material comprising:

at least one insulated conductive wire; and a warp-knitted fabric containing loops formed from a non-heat soluble yarn and a heat-soluble yarn, wherein one or more wire-containing regions are formed in the warp-knitted fabric, where each wire-containing region is defined by a first non-heat soluble yarn thread at a first position and by a second non-heat soluble yarn thread at a second position, and the at least one conductive wire is laid in a pattern that passes through the loops of the warp-knitted fabric in one of the at least one or more wire-containing regions such that a locking stretch of the yarn within the warp-knit fabric is less than the pattern stretch of the conductive wire.

13. The composite material of claim 12, wherein the conductive wire is laid in a zig-zag or sinusoidal pattern through the wire-containing region of the warp-knitted yarn.

14. A composite material comprising a substrate and the wire-containing region of the composite material of claim 12.

15. A process to form a composite material, the process comprising the steps of placing the composite material of claim 12 onto a substrate, applying heat and removing the non-wire-containing regions.

16. The composite material of claim 3, wherein the metal wire is formed from a plurality of wirelets, each having a diameter of from 5 μm to 200 μm.

17. The composite material of claim 3, wherein the high-temperature insulated metal wire further comprises a polymeric core material surrounded by the metal wire.

* * * * *